United States Patent [19]

Skovgaard et al.

[11] Patent Number: 4,692,882

[45] Date of Patent: Sep. 8, 1987

[54] APPARATUS FOR RECORDING THE SPEED OF A VEHICLE

[76] Inventors: Helge Skovgaard, No. 4 Holmegårdsparken, 2980 Kokkedal; Kent Johansen, Paul Bergsoe Kollegiet, No. 190 Skodsborgvej, 2850 NÆrum, both of Denmark

[21] Appl. No.: 689,549

[22] PCT Filed: Apr. 27, 1984

[86] PCT No.: PCT/DK83/00050

§ 371 Date: Dec. 19, 1984

§ 102(e) Date: Dec. 19, 1984

[87] PCT Pub. No.: WO84/04415

PCT Pub. Date: Nov. 8, 1984

[51] Int. Cl.[4] ..... G07C 5/08

[52] U.S. Cl. ..... 364/565; 364/424; 340/52 H; 346/33 D; 324/166

[58] Field of Search ..... 364/565, 424; 346/33 D, 346/33 R; 324/160, 161, 163, 166, 172; 340/52 R, 52 H

[56] References Cited

U.S. PATENT DOCUMENTS

| | | | |
|---|---|---|---|
| 4,223,297 | 9/1980 | Nomura et al. | 324/166 |
| 4,250,487 | 2/1981 | Arnold | 346/33 D |
| 4,281,388 | 7/1981 | Friend et al. | 364/565 |
| 4,315,213 | 2/1982 | Wolff | 364/565 |
| 4,398,260 | 8/1983 | Takahashi et al. | 364/565 |
| 4,527,248 | 7/1985 | Takase et al. | 324/160 |
| 4,569,027 | 2/1986 | Nakano et al. | 324/160 |
| 4,584,528 | 4/1986 | Ohmae et al. | 324/166 |

*Primary Examiner*—Gary Chin

*Attorney, Agent, or Firm*—Sughrue, Mion, Zinn, Macpeak and Seas

[57] ABSTRACT

Vehicle speed values are preliminarily stored in an apparatus including a pulse generator 2 coupled to a speed sensor 1, a microprocessor 4 and an electronic memory 14, and a visual speed reconstruction is provided by reading out data from the memory 14 to an external recording instrument 32. The pulses generated with separations corresponding to a given road length act as interrupt signals for a counting operation performed in the microprocessor 4 so that the count or a speed value derived therefrom is transferred for each interrupt signal to the memory 14. The memory has a number of series-arranged memory blocks 15–18 having cyclically addressed memory locations arranged as circular lists and divided into sections having an equal number of memory locations, with a marking of the first memory location in each section. At the addressing of a marked memory location, a single function value is generated on the basis of the data content of all the memory locations in the section, said function value being transferred to a memory location in the next memory block. The power supply to microprocessor 4 and the memory 14 may be switched over from the battery 29 of the vehicle to internal voltage sources 10, 28 at decline of battery 29 as well as at stops of the vehicle.

6 Claims, 2 Drawing Figures

APPARATUS FOR RECORDING THE SPEED OF A VEHICLE

BACKGROUND OF THE INVENTION

The invention relates to digital vehicle speed recorders for recording the speed of a vehicle over a predetermined distance, and in particular to such recorders comprising a pulse generator connected with a velocity sensor in the vehicle for generating control pulses with a pulse separation corresponding to a given road length, and having means for providing speed values on the basis of said control pulses and internally generated clock pulses, and a speed value memory for storing said speed values with a recording rate dependent on the distance covered as well as read-out means associated with the memory for connection with a reproducing instrument for obtaining a visual presentation of the speed values stored in the memory.

Hitherto, the use of such recorders to obtain a presentation of the speed of a vehicle over a given road length preceding a certain reading time, for example in case of traffic accidents, has mainly been limited to large vehicles like trucks and busses. In prior art devices having built-in, at least partly mechanically operating curve-drawing instruments, the recorders have been relatively complicated and, in addition, sensitive to mechanical influences during operation, so that they have often been rather inefficient with respect to producing a speed presentation in connection with an accident.

In more recent devices of the kind mentioned, such as described, for instance, in German Pat. Nos. 2,929,168 and 3,123,879, the problems caused by mechanically operating parts have been remedied through a fully electronic data storage in the recording device installed in the vehicle itself in combination with a separate external reproducing instrument, by means of which a visual speed presentation may be produced by connecting the instrument to the recording device in the vehicle and reading out the data recorded therein.

However, the devices known from the above mentioned publications suffer from the disadvantages that they have either been relatively complicated with considerable demands on storage capacity of the electronic memory due to a desire to record operational parameters other than the speed, for instance a clock indication for each record, the number of revolutions and consumption of fuel, or offer only the possibility of a speed presentation for a very limited road length due to the memory design itself.

The apparatus described in German Pat. No. 2,929,168 uses a semiconductor memory having three series-connected FIFO-shift registers for storing pulses from a road distance sensor together with time indicators in the first location in the first shift register. For each pulse, the time indication is advanced in the first shift register, and at the transfer to the next and the following shift registers a data depletion is accomplished in that such later shift registers are clocked with lower frequencies than the shift frequency for the first shift register, for instance the half or one fifth of this frequency, whereby only every second or every fifth entry will be transferred from one shift register to the next. In practice, with this memory design the speed reconstruction or presentation will be limited to a road length of some hundred meters.

In the apparatus according to German Pat. No. 3,123,879, a buffer-controlled CMOS-memory is used and in addition to speed, data is stored for several operational parameters with a time indication associated with each record. The data concentration in the memory is accomplished in this case by a discontinuous storage, whereby new data are only recorded if they have either changed to a predetermined extent since the preceding entry, or a predetermined maximum road distance between two entries has been exceeded. The microprocessor used as calculating unit must be programmed to perform the comparison operations necessary therefore on several levels.

SUMMARY OF THE INVENTION

It is an object of the invention to provide a simple and inexpensive speed recorder of the kind mentioned which with respect to costs as well as operation is suitable for installation even in private motor cars and which may also be easily installed in existing vehicles.

With this object in mind, the apparatus according to the invention is characterized by the following features:

The pulse generator is connected to a first interrupt input of a microprocessor having a working memory space operating as a counter and incremented by internally generated clock pulses, said memory space being connected with said first interrupt input to transfer, at each pulse from the pulse generator functioning as an interrupt signal or by an internal interrupt signal generated by exceeding a stored predetermined maximum value of said count, said count or said maximum value, respectively, or a speed value derived therefrom for recording in the electronic memory.

The electronic memory comprises a number of memory blocks coupled in series and each having a number of memory locations in a circular arrangement, said locations being individually addressable from a working memory space in the microprocessor functioning as an address register in a continuous, cyclically repeated order of succession, said memory locations in each block except the last one being arranged in a number of memory sections with a marking associated with the first addressed location in each section.

A first memory block is addressed from the microprocessor in response to each interrupt signal at said first interrupt input or said internal interrupt for continuous individual recordal of said counts or said maximum value, respectively, or the speed value derived therefrom in the memory locations of the first memory block.

All memory blocks except the last one have a data output connected on one hand to all memory locations of the memory section containing the last addressed memory location, and on the other hand, to a data input connected with the arithmetic-logic unit of the microprocessor for transferring the measuring values in said memory locations to said arithmetic-logic unit at each addressing of a marked memory location in the actual memory block for producing a single function value on the basis of the measuring values in all said memory locations.

Each memory block after the first one is addressed by the microprocessor in response to each addressing of a marked memory location in the preceding memory block for continuous individual recordal of function values originating from preliminary data in memory sections in the preceding memory block.

With this design, only the counter values directly obtained by the road length pulses or possibly speed values derived therefrom by a simple calculation are stored in the electronic memory, i.e. without simultaneous clock indications, for each of the interrupt signals supplied from the pulse generator with a pulse separation corresponding to the constant road length, the speed value for each recording being obtained by dividing a constant by the number corresponding to the count or value obtained since the preceding interrupt signal either in the microprocessor in the recorder installed in the vehicle or in the external reproducing instrument which may be designed as a portable terminal.

The data depletion or recording rate reduction is performed continuously by means of a very fast storage algorithym requiring only a very simple calculating operation, such as a comparison operation, at the transfer from one memory block to the next.

Both of these factors imply that with a memory of limited capacity and current consumption, such as a 2 Kbyte CMOS-RAM-memory, continuous recordings may be made of speed values for a reconstruction of the speed course over a considerable road length exceeding one hundred kilometers with a logarithmically increased data depletion or recording rate reduction such that the most recently travelled road length is reproduced with a relatively fine resolution corresponding, for instance, to a road length of only 2 meters between successive recordings.

BRIEF DESCRIPTION OF THE DRAWINGS

In the following, the invention will be further explained with reference to the drawings, in which.

DETAILED DESCRIPTION OF THE PREFERRED EMBODIMENT

Figure 1:
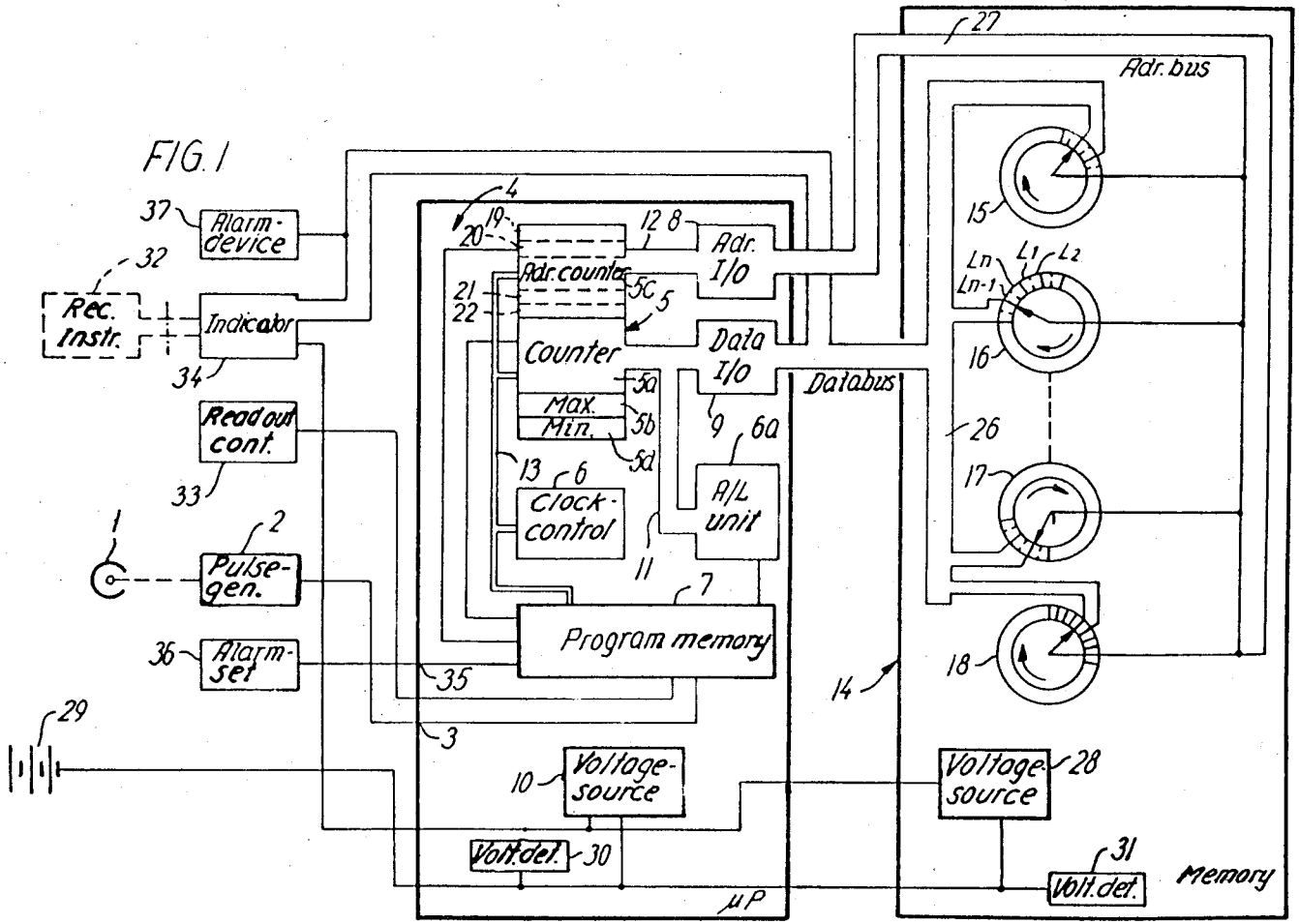
FIG. 1 is a block diagram of an embodiment of a speed recording apparatus according to the invention.

In the embodiment shown in FIG. 1, a pulse generator 2 is coupled to a speed sensor 1 in a vehicle, for instance the speedometer cable of the vehicle, for generating pulses with a separation corresponding to a given constant road length or distance. For example, the pulse generator 2 may be an optical device with an apertured disc arranged between a light source and a photo detector, and proportioned to supply a pulse, for example, for every 2 m travelled by the vehicle.

The pulses from the pulse generator 2 are supplied as control signals to a first interrupt input 3 of a microprocessor 4, which may be of the CMOS-type, and are used therein as interrupt signals for a counter 5*a* in the working memory 5 of the microprocessor. Counter 5*a* counts the clock pulses supplied from the internal clock control 6 of the microprocessor between succeeding interrupt signals at the input 3. At each interrupt signal the count is read, and the counter 5*a* is reset to zero.

Additionally, a maximum value for the count is stored in a separate memory location 5*b* in the working memory 5. If the count between successive interrupt signals exceeds this maximum value, for instance because the vehicle has stopped, such excess count being continuously monitored by a comparison operation in the microprocessor 4, a second, internal interrupt signal is generated, in response to which the maximum count is read and the counter is reset to zero.

The count accumulated at an interrupt signal or said maximum value, respectively, represents a time indication which is inversely proportional to the speed, and the stored maximum value may by definition be taken to represent a speed of 0 km/h.

In addition to the units already mentioned, the microprocessor 4 comprises in a manner known per se a program memory 7 containing the programs necessary for the performance of the control and calculating operations, as well as addressing and data input/output gates 8 and 9, respectively, and an internal voltage source 10. These units may communicate with each other through bus lines 11, 12 and 13.

To record the count accumulated at each interrupt signal, or the speed value derived therefrom which may be calculated by a simple division in the arithmetic-logic unit 6*a*, the microprocessor 4 is connected with an electronic memory 14.

The memory 14 comprises a number of series-arranged memory blocks, of which the block diagram in FIG. 1 shows four such memory blocks 15, 16, 17 and 18, this number being, however, preferably greater, for instance eight, such as indicated by a dashed line. Each of the memory blocks 15 to 18 has a number of memory locations $L_1$, $L_2$ . . . $L_{n-1}$, $L_n$ arranged as a so-called "circular list" and addressed from an individual register block 19, 20, 21 and 22 functioning as a counter in a space 5*c* of the memory 5. Each of the register blocks 19, 20, 21 and 22 may be an m-bit counter, which is incremented by pulses from the clock control 6, m being determined in dependence on the number of memory locations in the blocks 15 to 18 by $2^m > n$. A suitable proportioning may be, for instance, $2^8$ memory locations in each block and an 8-bit register block in the address counter space 5*c*. In this way the memory locations of a block are addressed in a continuous, cyclically repeated order of succession for the individual writing of count or speed data supplied from the microprocessor 4 in individual memory locations.

In addition, in each of the memory blocks 15 to 18 the memory locations $L_1$ to $L_n$ are grouped in a number of memory sections preferably, but not necessarily, with an equal number of memory locations, for instance two, in each section, and in each of the memory blocks 15 to 18 with the exception of the last block 18, the first memory location in each section is marked, which in the case of two memory locations in each section may be accomplished by means of the least significant bit in the address indications for the memory locations. Thus, for instance, the value 0 for the least significant bit is associated with a marked memory location.

Figure 2:
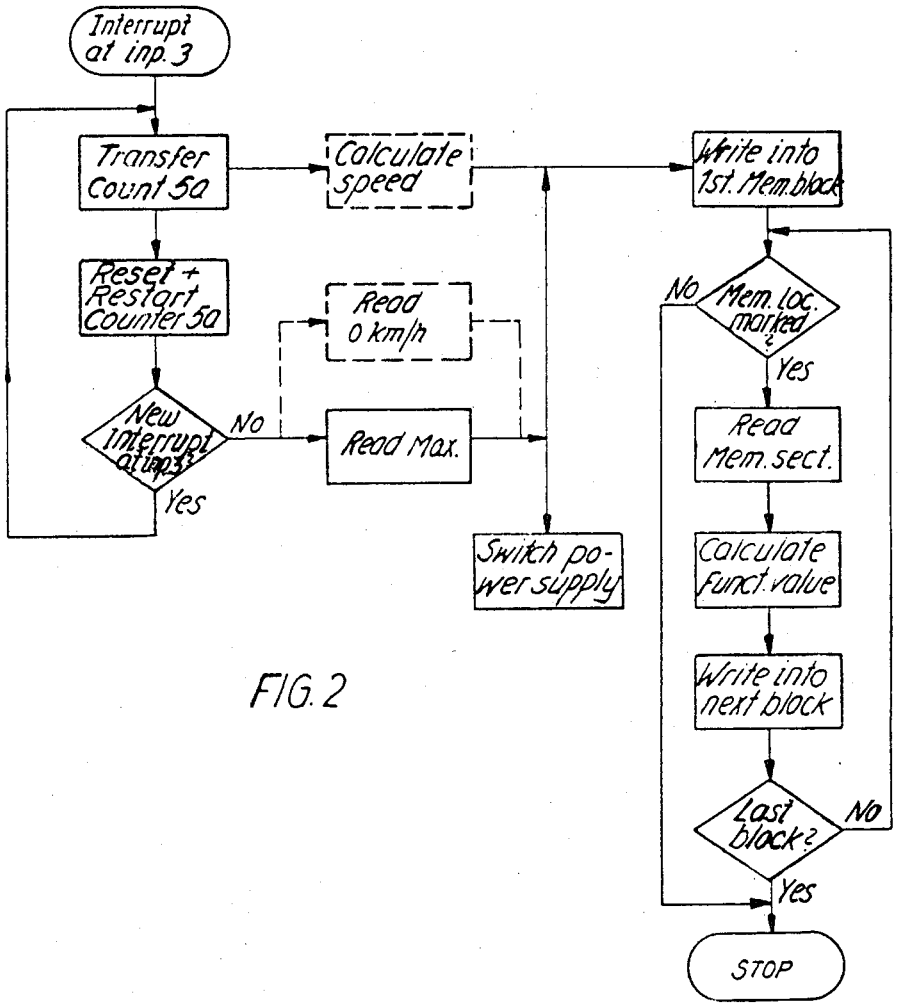
FIG. 2 is a flow chart for explaining the operation of the apparatus.

In the cyclic continuous addressing of the memory locations, they are individually connected successively to the microprocessor 4 for the reception of speed values therefrom and the transfer of data thereto, respectively, as explained below and illustrated in the flow chart of FIG. 2.

The first memory block 15 is addressed from the microprocessor 4 in response to each interrupt signal at the input 3 or each of the above mentioned internal interrupt signals generated when the maximum count value is exceeded, and in this way the counts occurring at the interrupt signals or said maximum value, respectively, are individually written into the memory locations of the first memory block 15.

Thus, at each interrupt data expressing a speed value will normally be recorded in each of the memory locations in the first memory block 15, and in the continuous recording of new data, the above mentioned marking of the first memory location in each of the sections consisting, for instance, of two memory locations, is now utilized in the first block 15 for transferring data to the next memory block 16 to implement a data depletion, by which data are only transferred to a single memory location in the next block 16 for each memory section of the block 15.

For this purpose, at each addressing of a marked memory location in a memory block by means of the associated register block in the address counter 5*c*, i.e. for instance when the least significant bit in the memory location address changes from 1 to 0, an internal interrupt signal is generated in response to which the microprocessor 4 reads out the speed values stored in all memory locations in the relevant section, i.e. both in the marked and the following memory location, to clear or empty these memory locations before writing new data into the marked memory location, and their speed values are transferred to the micro processor 4, the arithmetic-logic unit 6*a* of which on the basis of the data thus supplied, for instance two speed values, calculates a single function value which is transferred to and written into an addressed memory location in the next memory block 16.

This function value may typically be the minimum or maximum value or the average of the speed values recorded in individual memory locations in the emptied memory section so that the calculation thereof may be performed as a simple calculating or comparing operation in the microprocessor 4.

The continuous recording of data in the memory block 16, the transfer of data from this block to the following block, the writing of data into the latter, and so on, is performed in the same way, so that in each of the blocks with the exception of the last block 18, the clearing of the memory locations of the relevant section is accomplished by the addressing of the marked memory location, and the data content thereof is transferred to the microprocessor 4 for the calculation of a single function value to be transferred to the following memory block. As mentioned, in the last memory block 18 none of the memory locations are marked, and in the writing of the function values calculated on the basis of speed values from the memory sections of the block 17 into the individual memory locations of the block 18, a simple overwriting is made by which the oldest speed value is continuously cancelled for each new record written into the block 18.

Thus, the recording and transfer of speed and function values may be described as recording for each interrupt signal at the input 3 either a new count or said maximum value, respectively, or a speed value corresponding thereto from the microprocessor 4 into the first memory block 15 of the memory 14, and for each addressing of a marked memory location in any of the blocks 15, 16 and 17 the transfer of a function value from this block to the following block 16, 17 and 18, respectively.

Thus, in the case of m memory blocks, a speed value will be cancelled in the last memory block 18 for each $2^m$ new speed values written into the first memory block 15. If a new speed value is introduced into the memory block 15 for each road length L, and each memory block has $2^P$ memory locations, speed values will be stored in the electronic memory having a capacity of $m \cdot 2^P$ memory locations covering a road length of $$L \cdot 2^P \cdot (2^m - 1),$$

with a fine resolution for the most recently travelled length whose speed values are stored in the block 15, and with a gradually lower resolution for the older road lengths whose speed values are stored in the succeeding memory blocks up to and including the block 18.

Thus, with parameters of:

$L=2$ meter, $p=8$ and $m=8$, speed recordings for a road length of some 131 kms may be stored in an apparatus having an electronic memory 14 with a capacity of only 2 Kbyte.

The data communication and transfer of address signals between the microprocessor 4 and the memory 14 take place by means of bus lines 26 and 27, respectively.

In the same way as the microprocessor 4, the memory 14 is provided with a built-in voltage source 28.

During normal operation the power supply to the microprocessor 4 and the memory 14 takes place from the battery 29 of the vehicle. In connection with the internal voltage sources 10 and 28, battery voltage detectors 30 and 31, respectively, are provided in the microprocessor 4 and the memory 14, by means of which switching over to the internal voltage sources 10 and 28 is accomplished in case the voltage of the battery 29 drops below a predetermined level.

When stopping the vehicle, the voltage source 10 in the microprocessor 4 is actuated in response to recording a speed of 0 km/h by means of the above mentioned internal interrupt signal generated in the microprocessor when the predetermined maximum count value is exceeded.

In order to provide a visual presentation of the speed values recorded in the memory 14, the apparatus is adapted for connection to an external recording instrument 32, such as a strip chart recorder which may also have a display screen, as illustrated by dashed lines in FIG. 1. Read-out from the memory 14 is actuated by a contact 33, whereby all memory locations in the blocks 15 to 18 are addressed successively but in a reverse order from the recording succession such that the most recently recorded speed values are transferred first.

The read-out and the speed presentation may be interrupted at any point within the total road length covered by the records in the memory 14, if a need only exists for examining a limited part of this length.

To indicate correct operation of the apparatus to the driver of the vehicle, an indicator 34, which may comprise a photo diode, may be provided to indicate the functioning of the apparatus.

As a special feature of the invention, such an indicator may serve as a connecting member for the recording instrument 32 which may for this purpose have a shielded photo sensitive detector which is brought into an optical transfer communication with said photo diode, whereby the stored speed values may be transferred as optical signals and the recorder installed in the vehicle may be designed as a closed box having small dimensions and no accessible electrical terminals.

According to a further feature of the invention, the microprocessor 4 may be utilized in a simple manner for generating an alarm when a maximum speed selected by the driver and corresponding, for instance, to a local speed limit is exceeded by the vehicle.

For this purpose, an alarm setting contact 35 operated by the driver when the vehicle has reached the desired maximum speed is connected to a second interrupt input 36.

In operation of the contact 35, an interrupt signal is supplied to the microprocessor 4 which in response thereto transfers the count accumulated at the next pulse from the pulse generator 2 at the input 3 as a minimum value to a memory location 5*d* in the working memory 5. Subsequence to this alarm adjustment the counts actually assumed at each succeeding interrupt signal of the input 3 are compared with the minimum value in the arithmetic-logic unit 6*a*, and when the actual count is lower than the minimum value, an alarm signal is supplied to an acoustic or optical alarm device 37.

We claim:

1. A digital vehicle speed recorder for recording successive speed values of a motor vehicle over a predetermined road distance, comprising:

a pulse generator connected to a velocity sensor in the vehicle for generating control pulses with a pulse separation corresponding to a given road length, a clock generator for generating internal clock pulses, a microcomputer for calculating said speed values on the basis of said control pulses and said clock pulses, a speed value memory for storing successive speed values with a recording rate dependent on the road distance covered, and read-out means associated with said memory for connection with a reproducing instrument for obtaining a visual presentation of the speed values stored in the memory, said microcomputer having a first interrupt input connected to said pulse generator, said microcomputer including in its working memory a counter connected to said clock generator to be incremented by said clock pulses, a memory location for storing a predetermined maximum of the counter value, and comparator means connected to said counter and said memory location for continuously comparing the actual counter value in said counter with said maximum counter value and generating an internal interrupt signal when said counter value exceeds said maximum counter value, said counter and said memory location both being connected to said speed value memory to transfer, in response to each pulse supplied from said pulse generator to said first interrupt input or in response to said internal interrupt signal, whichever occurs first, said actual counter value or said maximum counter value, respectively, or a speed value derived therefrom to said speed value memory, said speed value memory comprising a plurality of memory blocks coupled in series and each having a number of memory locations connected in a circular arrangement, said locations being individually addressed from addressing means in the working memory of said microcomputer in a cyclically repeated order of succession, said memory locations in each block except the last block being grouped in a number of memory sections such that:

a first memory block is addressed from said addressing means in response to each interrupt signal at said first interrupt input or said internal interrupt, whichever occurs first, for successively recording said counter values or said maximum, respectively, or speed values derived therefrom in the memory locations of the first memory block, all memory blocks except the last one are controlled by said addressing means to address all memory locations of the memory section containing the latest addressed memory location for transferring the speed values in said memory locations to an arithmetic-logic unit of said microcomputer in response to addressing of a predetermined one of said memory locations for calculating a single function value on the basis of all the speed values stored in said memory locations, and the memory locations of each memory block after the first block are successively addressed by said addressing means for recording function values calculated from the speed values stored in memory sections in the preceding memory block.

2. A recorder as claimed in claim 1, wherein the speed value memory has eight memory blocks, each having 256 memory locations arranged with two memory locations in each memory section, and the addressing means associated with each memory block is an 8-bit shift register.

3. A recorder as claimed in claim 1 or claim 2, said microcomputer further comprising means for monitoring the battery voltage of the vehicle, internal voltage sources associated with the microcomputer and the speed value memory and means for switching over from the battery of the vehicle to said internal voltage sources in response to a failure of the battery of the vehicle.

4. A recorder as claimed in claim 3, further comprising separate visual indicator means for indicating said switching over from the battery of the vehicle to said internal voltage sources.

5. A recorder as claimed in claim 4, wherein said recorder reproducing instrument has a shielded, photosensitive detector for recording optical signals read out from said indicator means.

6. A recorder as claimed in claim 1, wherein a second input of the microcomputer is connected to an alarm adjustment contact to transfer, in response to the actuation of said contact, the counter value obtained at the following interrupt signal at said first interrupt input or the speed value derived therefrom as a minimum or maximum value, respectively, to a separate memory location of the working memory and to subsequently compare at each following interrupt signal at said first input the actual count with said minimum or maximum value and supply an alarm signal to an alarm device microcomputer, if said actual count is lower than the minimum value or higher than the maximum value.

* * * * *